United States Patent [19]

Matsumoto

[11] Patent Number: 4,954,203

[45] Date of Patent: Sep. 4, 1990

[54] LABELLING SYSTEM

[75] Inventor: Mitsuo Matsumoto, Hyogo, Japan

[73] Assignees: Kanzaki Seishi Co., Ltd., Tokyo; Sun-Tec Co., Ltd., Hyogo, both of Japan

[21] Appl. No.: 280,020

[22] Filed: Dec. 5, 1988

[30] Foreign Application Priority Data

| | | | |
|---|---|---|---|
| Dec. 7, 1987 | [JP] | Japan | 62-186199[U] |
| Dec. 7, 1987 | [JP] | Japan | 62-186200[U] |
| Dec. 7, 1987 | [JP] | Japan | 62-186201[U] |
| Dec. 7, 1987 | [JP] | Japan | 62-186202[U] |

[51] Int. Cl.[5] ..... B65C 1/00

[52] U.S. Cl. ..... 156/361; 156/363; 156/542; 271/150

[58] Field of Search ..... 156/361–364, 156/566, 540–542; 271/150, 151, 303, 276, 31.1

[56] References Cited

U.S. PATENT DOCUMENTS

| | | | |
|---|---|---|---|
| 3,721,601 | 3/1973 | Pituch et al. | 156/542 |
| 3,894,732 | 7/1975 | Muller | 271/150 X |
| 3,988,017 | 10/1976 | Kyhe | 271/150 X |
| 4,108,706 | 8/1978 | Brands et al. | 156/540 X |
| 4,548,404 | 10/1985 | Brandt et al. | 271/303 |
| 4,597,571 | 7/1986 | Redding et al. | 271/150 |
| 4,688,782 | 8/1987 | Browne | 271/31.1 X |

*Primary Examiner*—David Simmons

*Attorney, Agent, or Firm*—Schweitzer & Cornman

[57] ABSTRACT

An improved labelling system for automatically applying labels one at a time in sequence to a series of items, such as post cards, etc., is disclosed. Post cards or other articles are conveyed one at a time to a labelling position. Separately, a carrier web, releasably carrying adhesive labels, is also conveyed to the labelling position. The carrier web is sharply reversed about a narrow edge, enabling the label to be peeled off and applied to a post card or the like being conveyed automatically underneath. A plurality of pairs of elements, including drive rollers and pressure-applying devices cooperating therewith, are utilized to controllably advance the carrier web through the labelling unit. As a feature of novelty, the labelling unit is pivotally mounted in relation to the conveying means for the post cards or the like. When the labelling unit is pivoted away from the conveying path, all of the cooperating pressure members are automatically retracted from their respective driving rollers or other cooperating elements, so that the carrier web is entirely freed from its driving and controlling elements. This greatly expedites and facilitates the threading of label carrier webs into the system.

8 Claims, 10 Drawing Sheets

LABELLING SYSTEM

BACKGROUND AND PURPOSE OF THE INVENTION

The present invention concerns a labelling system which automatically pastes labels carrying messages, advertisements, etc. to objects such as post cards and the like.

In recent years, communication with customers, etc. has become indispensable for various business activates, such as financial, health, credit, mass sale industries, etc., as well as in government and municipal offices, and there is a growing need for labor saving devices for use in such communications.

In such communication work, one cannot make an effective use of post cards, for example, if one writes messages on them manually as in the past. Moreover, direct printing on cards is often unsuitable for messages different from one another.

So the present invention realizes a saving of labor in communication work by using labels, indicating written messages of different contents or other communication matters such as common advertisements, and automatically fastening them to cards.

Heretofore, there has been no suitable system capable of fastening labels automatically and rapidly to a large quantity of objects such as post cards. Accordingly, a primary purpose of the present invention is to provide an automatic labelling system which automatically and rapidly performs this task.

The greatest difficulty encountered in the development of this kind of automatic labelling system has been to make it possible to carry a large quantity of post cards, etc. rapidly up to the labelling position and feed them in the labelling position securely in a single line, one by one in good order. If more than one object is fed simultaneously into the labelling position it naturally leads to producing defective products without label and spoiling the reliability of the system. A second purpose of the invention, therefore, is to make it possible to transfer a large quantity of objects quickly and feed them reliably into the label pasting position in a single line one by one for correct labelling.

Another important aspect of the new automatic system is the ease of replacement or setting of labels to be pasted, since in many cases the labels are different from one another in content, because if the replacement or setting of labels on the system cannot be performed easily the system cannot be put to practical use.

Accordingly, a further purpose of the present invention is to enable easy replacement and setting of labels in the automatic system.

Other purposes and effects of the present invention will be clarified in the course of the explanation of examples given hereafter.

DETAILED DESCRIPTION OF PREFERRED EMBODIMENTS

Figure 1:
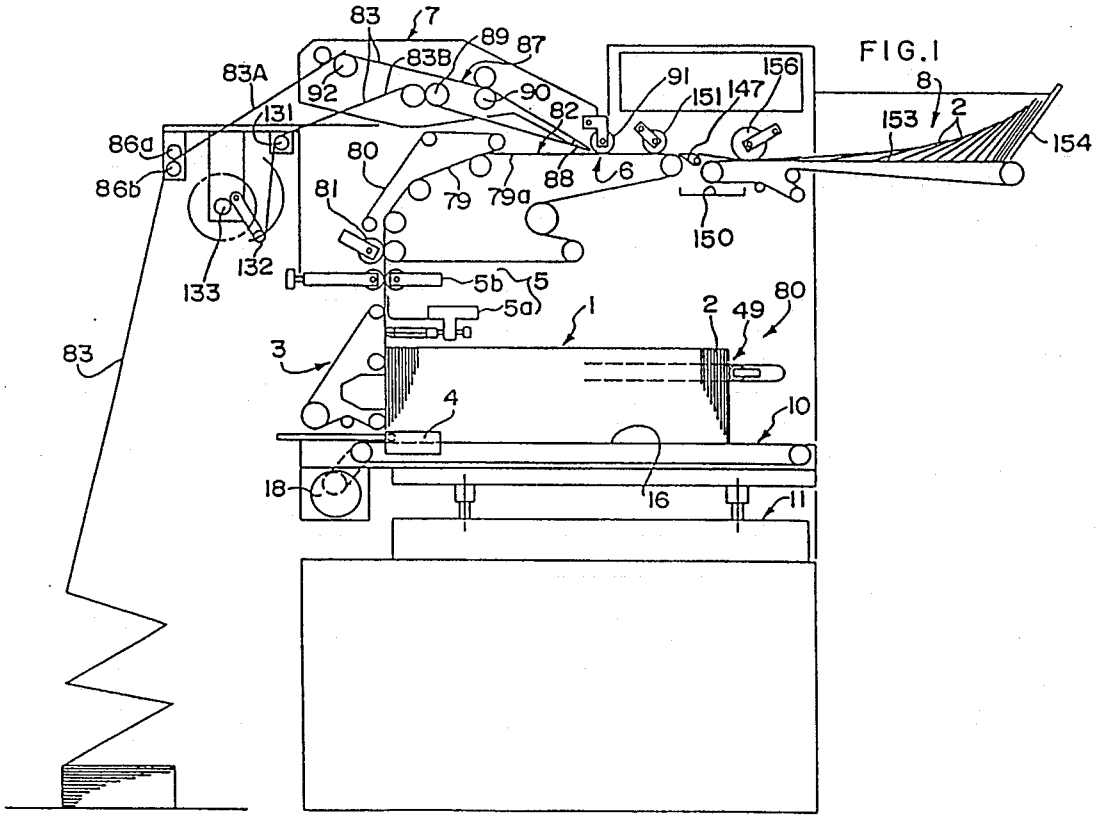
FIG. 1 is a general schematic diagram of an example of the present invention.

FIG. 1 constitutes an outline of the entire system, and FIGS. 2–19 provide detailed explanations of the individual component parts.

The reference numeral 1 indicates, generally, a means of conveyance in the horizontal direction. A large number of cards 2, which are placed one upon another, are conveyed by this device successively in a horizontal direction in upright position.

3 is the means for conveying cards individually in a vertical direction. The cards 2, which are successively carried by the means of the horizontal conveyance 1 are carried vertically upward by the conveyor 3. The cards are caused to be carried successively up to the labelling position 6, at the top of the system, one by one in a line, with the help of a lower separating device 4 provided with the horizontal conveyor 1 and an upper separating device 5 provided with the vertical conveyor 3.

7 is the means of label pasting. As will be further described, the cards 2, being carried to the labelling position 6, are furnished with labels automatically by the label pasting device 7 in this position.

8 is the means for collecting the labelled post cards. The cards 2 which have been furnished with labels by the label pasting device 7 are automatically collected by this collecting device 8 successively and taken out as finished products.

Referring to FIGS. 2–5, 9 is the card conveying route of the horizontal conveyor 1 and is provided with a conveyor mechanism 10 which horizontally supports and carries a large number of cards placed one against another in the state in which each card is kept in upright position. The conveyor mechanism 10 includes a conveyor frame 12 supported for adjustable height by the height adjusting device 11. A conveyor belt 16 is stretched between a driving roller 13 and a free roller 14 supported by shafts in the said conveyor frame 12. The belt 16 moves in sliding contact with a supporting plate 15. It is driven by a motor 18 which is supported under one end of the said conveyor belt 12 and is connected through a transmission belt 17 to the said driving roller 13. A side wall plate 19 is mounted on a fixed frame on one side of the conveyor mechanism 10, and the lateral face 19a on the side of the card conveying route 9 is the card guide face.

The height adjusting device 11 is provided for the purpose of adjusting the carrying level of the conveyor 10, depending on the height dimension of the card 2. It includes two (front and rear) spiral shafts 21a, 21b carried on the base 20 in such a way that they can turn only on their own axes. A transmission belt 23 is stretched between pulleys 22a, 22b fixed at the lower ends of the two spiral shafts 21a, 21b. A handle 24 is attached to the lower end of one of the spiral shafts 21a. Threaded members 25a, 25b are received on the spiral shafts 21a, 21b and fixed to the bottom of the said conveyor frame 12. The conveyor frame 12 (conveyor 10) is caused to go up and down by rotating the two spiral shafts 21a, 21b in the same direction with a turning of the handle 24

The vertical conveyor 3, disposed at the downstream end of the card conveying route 9, is provided with a suction box 26 and a perforated conveying belt 27. The suction box 26 is provided with a multiple number of suction ports 28 (FIG. 4 and FIG. 5) elongated in a longitudinal direction and spaced in a transverse direction. These ports are open over the vertical end face 26a facing toward the direction of conveyance of the post cards. A suction cavity 29 communicates with the suction ports 28 and with a suction pipe 30. The perforated conveying belt 27 is stretched on free rollers 32, 33a, 33b, a take-up roller 34 and a driving roller 35, which are supported between left and right side plates 31, so that the belt may move in sliding contact with the vertical end face 26a of the suction box 26. The belt 27 is provided with small-diameter openings 27a at small intervals in the circumferential direction, aligned with the suction ports 28.

When a negative pressure is produced inside the cavity 29 of the suction box 26 by evacuating it through the suction pipe 30, a force due to a difference of pressure with the external air is exerted on the opening 27a of the conveying belt 27 facing the suction ports 28. By turning the driving roller 35, by means of a motor (not indicated on the drawing), to drive the front face of the conveying belt 27 in an upward direction, it is possible to draw a post card 2 to the vertical belt face and carry it upward.

Figure 2:
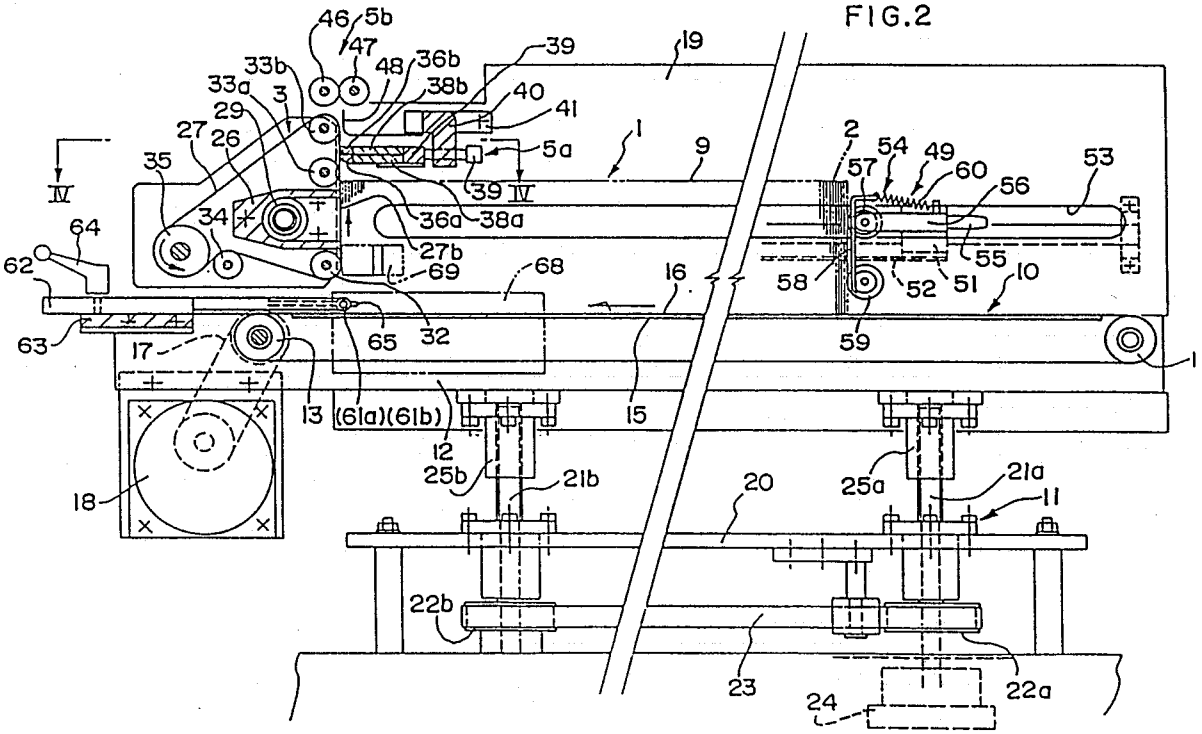
FIG. 2 is a partial longitudinal sectional view of the means of horizontal conveyance and the means of vertical conveyance as well as their surroundings.
Figure 3:
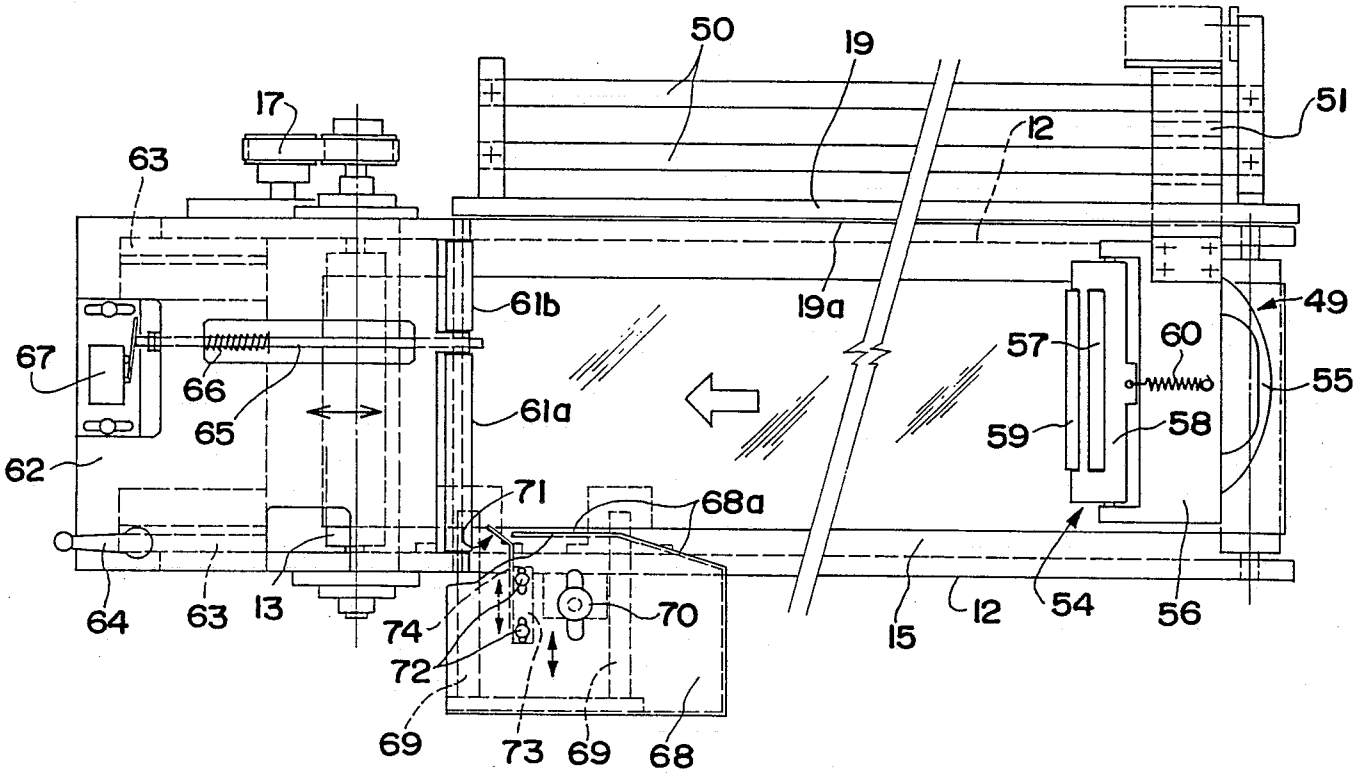
FIG. 3 is a top plan view of the equipment of FIG. 2.
Figure 6:
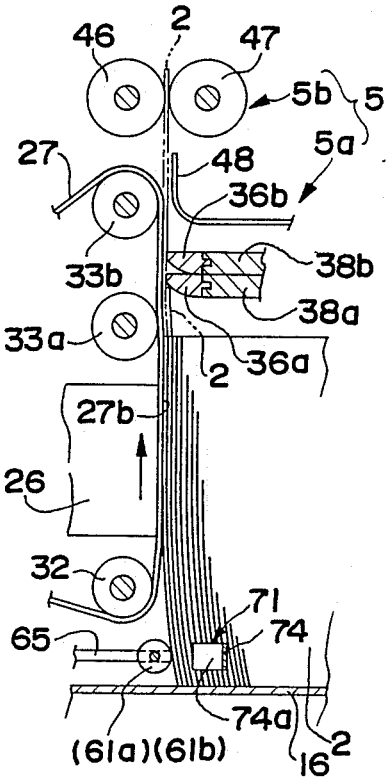
FIG. 6 and FIG. 7 are fragmentary longitudinal sectional views of important parts explaining the working condition of the above.
Figure 7:
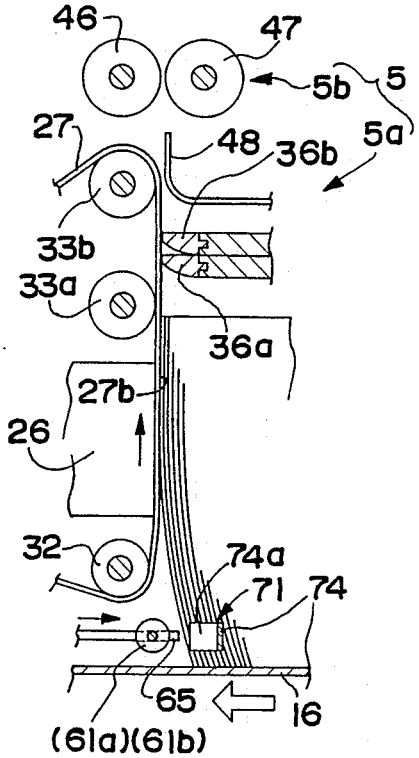
Figure 8:
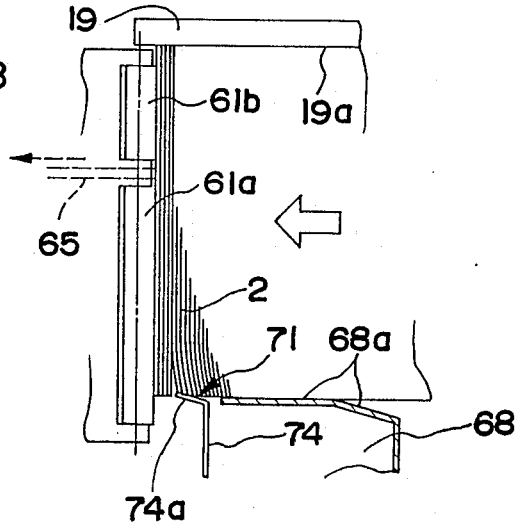
FIG. 8 is a fragmentary transverse sectional view of the mechanisms of FIGS. 6 and 7.

The reference numeral 5a (FIGS. 6, 7) designates the first upper card separating device provided at the top of the vertical conveyor 3. The separating device 5a consists of separators 36a, 36b which are disposed in such a way as to contact the vertical face 27b of the perforated conveyor belt 27 at the middle position between the vertically spaced free rollers 33a, 33b. The separators 36a, 36b allow only the first post card 2 that comes up to pass, and thus function to separate it from the subsequent post cards 2 following along. An adjustment 37 (FIG. 4) adjusts the contact pressure between the separators 36a, 36b and the conveyor belt 27. The separators 36a, 36b are made of hard rubber and are formed of somewhat triangular cross section as shown in the drawing (FIG. 2, FIG. 6, FIG. 7). They have a width about the same as that of the conveyor belt 27. The separators 36a, 36b are mounted on the edges of mounting boards 38a, 38b, respectively, and the mounting boards 38a, 38b are fixed one upon the other to a frame 39. The frame 39 is linked with a mounting base 40 through the adjusting device 37. The mounting base 40 is fixed to a supporting frame 41 installed above the discharge end the horizontal conveyor 10.

Figure 4:
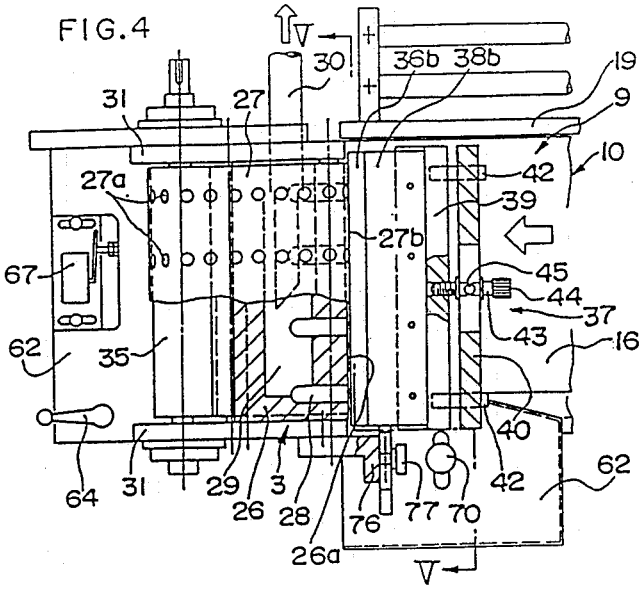
FIG. 4 is a sectional view as taken on line IV—IV of FIG. 2.

The adjusting device 37 includes, as shown in FIG. 4, of spaced guide rods 42 which protrude rearwardly from the ends of the frame 39 and are slidably received in guide holes in the mounting base 40. A threaded shaft 43 is mounted at the middle of the mounting base 40 in such a way that it can only rotate and is received in a threaded hole in the frame 39. The adjusting device 37 is designed in such a way as to make the frame 39 and the mounting boards 38a, 38b move forward and backward in a horizontal direction in relation to the mounting base 40 by turning the knob 44 at the end of the threaded shaft 43. This enables adjustment of the contact pressure of the separators 36a, 36b against the perforated conveyor belt 27. 45 is a locking screw used to fix the threaded shaft 43 relative to the mounting base 40 in a desired position.

A second post card separating device 5b is provided above the first. The second separating device 5b comprises a feed roller 46 and a reverse turning roller 47 supported in parallel relation with a gap between them corresponding approximately to the thickness of a post card. At least one of those rollers, the roller 46 for example, is subjected to a fine adjustment of position with regard to the other, e.g., the reverse turning roller 47, to make a fine adjustment of the gap between the rollers 46, 47 depending on the thickness of the post card 2. While the feed roller 46 is a single longspan roller continuous in the direction of width of the card 2, the reverse-turning roller 47 consists of a multiple number of short rollers mounted at proper intervals on a common driving shaft. A guide plate 48 is positioned below the roller 47.

When post cards 2 are carried toward the lifting conveyor 3 by means of the horizontal conveyor belt 16, the first card is conveyed upward by the perforated conveyor belt 27 after contacting the vertical belt face 27b. If, at this time, there is only one post card 2 which is conveyed upward, that post card 2 can be forced into the gap between the separators 36a, 36b and the vertical face of the conveyor belt 27 and pass between those separators 36a, 36b and the conveyor belt 27. However, if two or more cards 2 are carried up one upon another by the belt 27, the second and subsequent post cards 2 are blocked by the lower separator 36a as indicated in FIG. 6. Even if, by any chance, the second card is not blocked by the lower separator 36a, it is blocked by the upper separator 36b, so that only the first card can pass through between the separators 36a, 36b and the conveying belt 27.

If the cards cannot be handled in single pieces by the first separating device 5a, they are handled piece by piece securely by the second separating device 5b. When a single card 2 is separated and sent up by the first separating device 5a it is able to pass through the rollers 46, 47 under the feeding action of the feed roller 46. However, if two cards are sent up one upon another, without being separated by the first separating device 5a, the external card is pushed down by the reverse-turning roller 47 and only the internal card passes between the rollers.

A pusher 49 prevents falling down of the vertically oriented cards. It pushes a movable unit 51, supported by two guide rods 50 (FIG. 3) installed horizontally on the outside of the side wall plate 19. The unit 51 is pushed in the direction of conveyance of the conveyor 10 by means of a pulling spring 52 (indicated in FIG. 2 by a broken line) of an approximately constant winding torque. A part of the movable unit 51 extends over the card conveying route 9 through a horizontal slot 53 provided in the side wall plate 19. It is provided with a card presser unit 54. The pressing unit 54 is constituted by a supporting member 56 mounted on the projected end of the movable unit 51 and having a handle 55. An upper card presser roller 57 is supported by the supporting member 56, and a supporting plate 58 is mounted to swing forward and backward, using the supporting shaft of the roller 57 as fulcrum. A lower card presser roller 59 is supported by the plate 58, and a spring 60 urges the supporting plate 58 in such a direction as to press the lower roller 59 forwardly. As the cards 2 are sent out successively by the vertical conveyor 3, the presser unit 54 automatically advances under the force of the power spring 52 to always press the card 2 at the rearmost end with an approximately constant pressing force, thus protecting it against falling backward.

Since the lower edges of the cards 2 supported by the conveyor belt 16, the desired pushing and support effect can be obtained sufficiently even if the supporting plate 58, the lower roller 59 and the spring 60 are omitted. Falling down of the post cards 2 can be prevented using only the upper card presser roller 57 mounted at the front end of the supporting member 56.

Numerals **61*a*, 61*b* designate lower separating rollers constituting a part of a lower card separating device 4. The rollers are supported in axial alignment at the end of a frame 62 in such a way as to be positioned immediately before and under the vertical conveyor 3. The frame 62 is adjustably supported for forward and backward adjustment along guide rails 63 fixed to the end of the conveyor frame 12. The frame is fixed in position after adjustment by a fixing handle 64. The numberal 65 designates a touch sensor rod supported by the side frame 62 to be movable forward and backward within a fixed range between the lower separating rollers 61*a*, 61*b*. The end of the rod protrudes beyond the card contact position, being pushed by a spring 66. 67 is a limit switch which detects the retreating (upstream) movement of the touch sensor rod under the force of the spring 66, and activates the driving motor 18 of the conveyor 10 to make the conveyor belt 16** start turning.

68 is a width aligning box disposed at the end of the card conveying route 9 on the side opposite to the side wall plate 19. It is provided with a guide face **68*a* which makes contact with the lateral edges of cards 2, as they are carried toward the lifting conveyor 3. This width adjusting box is supported to be adjustable in the direction of width by guide rods 69 on one side of the conveyor frame 12 and can be fixed by a screw 70 after adjustment. The width adjusting box is provided with a pushing device 71 which pushes the lateral edges of cards, near their lower edges, urging the cards sideways toward the guide 19*a*. The device 71 is located at a position somewhat upstream from the lower separating rollers 61*a*, 61*b*. The pushing device 71 includes a supporting member 63 attached to the width adjusting box 68 by means of two fixing screws 72 so as to be freely adjustable and fixable in the direction of width. A plate spring 74 is attached to the supporting member 73, and an edge 74*a* of this plate spring 74, protruding into the card conveying route 9, is angled toward the separating rollers 61*a*, 61*b***.

An upper width adjusting guide 75 is provided on one of side plates 31 of the lifting-conveyor 3, by means of a bracket 76, in such a way as to be positioned above the edge **74*a* of the plate spring 74. The upper guide 75 can be adjusted in the width direction, and a fixing screw 77 secures the guide in the position after adjustment. 78 is a lip projecting from the edge of the guide 75 and is located close to the vertical face 27*b* of the conveying belt 27**.

In a card feed system constituted as described above, a large number of cards 2 are placed one against another in an upright manner, as shown in FIG. 1, with one side edge of each card in contact with the inner guide face **19*a*. The cards are loaded on the conveyor belt 16 and are pushed manually in the direction of conveyance, so that the cards at the end are inside the guide face 68*a* of the width adjusting box 68 and the upper width adjusting guide 75. The presser unit 54 of the protective device 49** is put in contact with the back face of the card at the rear.

By operating the motor 18 to move the cards supported on the conveyor toward the lifting conveyor 3, the lower edge of the card at the head of the line comes in contact with the lower separating rollers **61*a*, 61*b* after pushing back the touch sensor rod 65 against the force of the spring 66. Since the limit switch 67 is actuated with the retreat of the touch sensor rod 65, the power supply to the motor 18 is thereby cut off and the conveyor belt 16** stops.

As described above, when a card is carried toward the lifting conveyor 3 by the conveyor belt 16, the presser unit 54 also moves automatically in the same direction, with the pushing force of the power spring to urge the tops of the cards 2 in the direction of conveyance. Therefore, when the lower edge of the card at the head of the line comes in contact with the lower separating rollers **61*a*, 61*b*, stopping the conveyor belt 16 as shown in FIG. 6, the top part of the card at the head of the line leans upon the vertical face 27*b* of the conveyor belt 27. In practice, a multiple number of cards from the head of the line are bent backward at their lower edges by the lower separating rollers 61*a*, 61*b*** and thereby separated from each other from the state of close adhesion.

Figure 5:
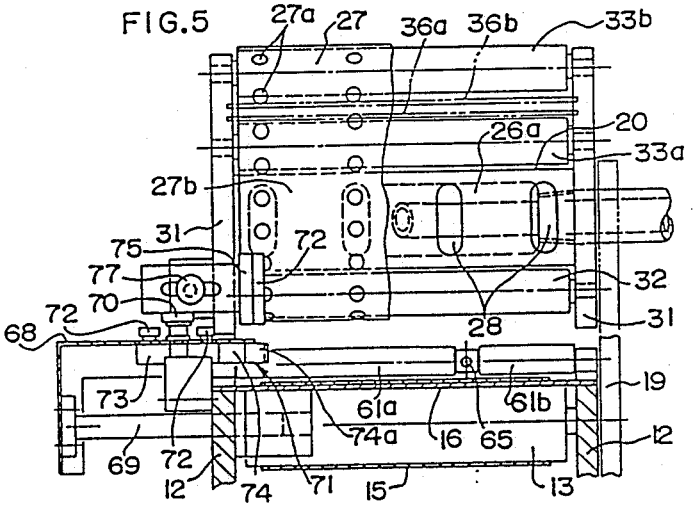
FIG. 5 is a sectional view as taken on line V—V of FIG. 4.

A number of cards located a little away from the card in the foremost position are pushed laterally toward the inner guide face **19*a* of the side wall plate 19, as a result of the pressing action of the end of the plate spring 74*a*, as indicated in FIG. 5 and FIG. 7. As a result, a kind of resistance against the conveyance by conveyor belt 16 is given to a number of cards found a little away from the foremost position, by being pinched in the width direction between the edge of the plate spring 74*a* and the inner guide face 19*a* of the side wall plate. Therefore, when the cards 2 are carried by the conveyor belt 16, each card falls somewhat behind the conveyor 16 in the position where it is pressed against the edge of plate spring 74*a*, and the pressing force among the cards becomes largest at this point, while the pressing force among a number of cards which have moved from the edge of plate spring 74*a* toward the lower separating rollers 61*a*, 61*b* remarkable decreases. As a result, when the touch sensor rod 65 is pushed back by the card at the head of the line to stop the conveyor belt 16, the lower edge of the card 2 in the foremost position is not pressed too strongly against the lower separating rollers 61*a*, 61*b* and the frictional resistance between the card at the head of the line and the card immediately behind it gets smaller, making it easy for the first post card 2** to be separated and pulled upward.

When the conveyor belt 16 is stopped upon the detection, by the limit switch 67, of the retreat of the touch sensor rod 65, the driving roller 29 of the lifting conveyor 3 is also driven at the same time to make the belt 27 start turning and to bleed air from the cavity 29 of the suction box, and then the card at the head of the line, the upper half of which is in contact with the vertical face **27*b* of the belt 27, is carried upward by the lifting conveyor 3. At this time, since the upper part of the subsequent cards is pushed in the direction of conveyance by the pusher 54, even if the conveyor belt 16 is stopped, the upper parts of the subsequent cards 2 come in contact successively with the vertical face 27*b* of the conveying belt 27** and are carried upward.

As the cards 2 are carried upward one by one, an open space is produced in the position immediately before the lower separating rollers **61*a*, 61*b* as indicated in FIG. 7 and the touch sensor rod 65 returns to its original position under the pressing force of the spring 66. As a result, the limit switch 67 is actuated to cause the motor 18 to be put into operation again. The conveyor belt 16 is driven to convey cards 2 on the conveyor belt 16 toward the lifting conveyor 3 until the limit switch 67** is again operated.

If, during the lifting of the card in the foremost position by the lifting mechanism 3, the subsequent cards 2 are not completely separated by the lower separating rollers **61*a*, 61*b* and, for that reason, one or several subsequent cards are sent together with the card in the foremost position, the cards carried by the conveyor belt 16 are caused to be correctly carried vertically one by one, by the said first and second upper separating devices 5*a*, 5*b***.

Cards 2 carried vertically through the said first and second upper separating devices **5*a*, 5*b* are directed through a pinch roller 81 (FIG. 1), and then are carried between belt conveyors 79 and 80, being eventually discharged on a horizontal conveying route 82. The conveying route is constituted by the horizontal section 79*a* of a belt conveyor 79. The conveyor 79 advance the cards with a certain space between, so that the cards are carried on the conveying route 82** at proper intervals.

Figure 13:
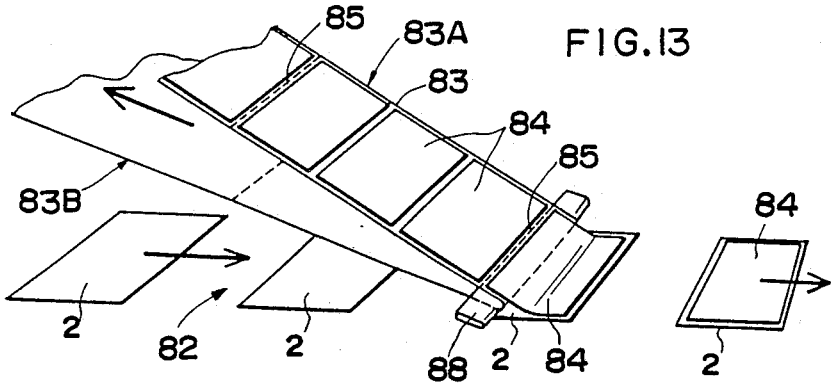
FIG. 13 is a perspective view illustrating the function of pasting labels on post cards.

A label carrier web 83A, which consists of a paper web having labels 84 on its surface at regular intervals in a detachable state, as shown in FIG. 13 is provided with perforation lines 85 at folds positioned at regular intervals between the labels 84. A supply of the web is placed on the floor, etc. in a folded state as shown in FIG. 1. In FIG. 13, three labels are shown adhered between spaced perforations 85, but such perforations 85 may be provided between all labels 84, depending on the size of the labels 84.

As shown in FIG. 1, the label-carrying web 83A, is supplied to the labelling unit 87 after passing through between tension rods **86*a*, 86*b*. The label pasting unit 87 includes, as shown in FIG. 9–FIG. 12, a knife edge member 88 which folds back and moves the carrier web 83A above the conveying route 82. A driving roller 89 pulls the carrier web 83B (after removal of its labels), around the tip of the knife edge member 88. A driving roller 90 supplies carrier with labels 83A to the said knife edge member 88. A label pressing roller 91 presses the labels 84, which are detached from the carrier web 83 as it is folded back at the tip of the said knife edge member 88, and thus adheres them to the surface of the card 2 being carried on the said conveying route 82. The said driving rollers 89, 90 are provided respectively with opposed presser rollers 93, 94, and a guide roller 92 for the incoming web is provided with an elastic braking board 95**.

96 is a mobile supporting plate located on one side of the transfer route of the label carrying web 83A. The driving rollers 89, 90 and guide roller 92 are supported at one end by the mobile supporting plate 96 and one end of the said knife edge member 88 is also fixed to the plate 96. The driving shaft **89*a* of the roller 89 is mounted above a base 97 and is supported by a fixed bearing plate 98 positioned along side the mobile supporting plate 96. Therefore, the mobile plate 96 can swing up and down about the axis of the driving shaft 89*a* and is urged by a power spring 99 in the direction to lift the label holding roller 91**.

A plate 101 projects laterally from the top of the mobile bearing plate 96 and is provided with a handle 100. An automatic mooring latch 102 is mounted under the plate 101, and a cooperating moored member 104 is fixed on the base 97 through a bracket 103. When the mobile bearing plate 96 is lowered down to the specified position against the force of the spring 99, a claw **102*a* of the latch 102 is automatically engaged with the moored member 104, preventing upward movement of the plate 96**.

105 is a proximity switch mounted on the moored member 104 and is turned on by proximity to the plate 101 when the movable bearing plate 96 is set in the specified position, enabling operation of label pasting system. The plate 101 is provided with an opening **101*a* for manipulation of the push button 102*b* for disengagement of the latch 102**.

The label holding roller 91 is supported by a shaft between a pair of bearing arms (left and right) 107 fixed to the rotary shaft 106, which is supported by the plate 96. The rotary shaft 106 is provided with a presser plate 108 which presses the label carrier 83A against the top surface of the said knife edge member 88. In addition, the rotary shaft 106 is provided, at the end extending through the mobile bearing plate 96, with an operating lever 109 installed to project in a radial direction. A power spring 110 is provided between a radially extending part of the said rotary shaft 106 and the said plate 101 so that this operating lever 109 is pressed into contact with a part of the said base 97. 111 is a stopper pin which limits the range of turning of the said operating lever 109 and is mounted to project from the mobile bearing plate 96.

The presser rollers 93, 94 are supported by pairs of bearing arms 114, 115 fixed to rotary shafts 112, 113. The shafts in turn are supported by the movable bearing plate 96. The rollers 93, 94 are pressed against the respective driving rollers 89, 90 by power springs 118, 119 stretched between intermediate arms 116, 117 installed to project from those rotary shafts 112, 113. The rotary shafts are provided with rocker arms 120, 121 at the ends of the shafts protruding to the opposite side of the movable bearing plate. Cam follower rollers 122, 123, supported at the free ends of those arms 120, 121, are received in free state in indentations 125, 126 of a fixed disk-shaped cam 124 fixed to the said bearing plate 98 concentrically with the driving shaft **89*a*. The mounting angle of the arms 120, 121 is adjusted in such a way that when the cam follower rollers 122, 123 are received in the indentations 125, 126, the presser rollers 93, 94 are pressed against the driving rollers 89, 90 with the pushing force of the springs 118, 119**.

The elastic braking board 95, provided along side the guide roller 92, is mounted at two axially spaced points on a rotary shaft 127, one end of which is supported by the said mobile bearing board 96. The free end of the braking board is pressed elastically against the top of the peripheral face of the said guide roller 92. An operating lever 128 is installed to project radially from this rotary shaft at the end projecting through the movable bearing plate 96. This operating lever 128 is urged upward by a power spring 129 stretched between the lever 128 and the movable plate 96. A stopper pin 130 is adjustably mounted on the side of the fixed bearing plate 98 and maintains the arm 128 at an angle at which the said elastic braking board 95 is pressed against the peripheral face of the guide roller 92.

The label carrier 83A is made to pass between the guide roller 92 and the elastic braking board 95, then between the driving roller 90 and the presser roller 94, and thereafter between the knife edge member 88 and the presser plate 108 to reach the edge of the knife member 88. The web then turns back sharply along the edge of the knife member 88 and passes between the driving roller 89 and the presser roller 93.

When initially threading the label carrier 83A on the labelling unit 87 or in the case of maintenance, inspection, repair , etc., the push button **102*b* is pushed to separate the claw 102*a* from the moored member 104. The movable bearing plate 96 is thus opened by pivoting around the driving shaft 89*a*, with the help of the spring 99, by means of the handle 100 as indicated by broken lines in FIG. 2 and FIG. 3** respectively.

Figure 11:
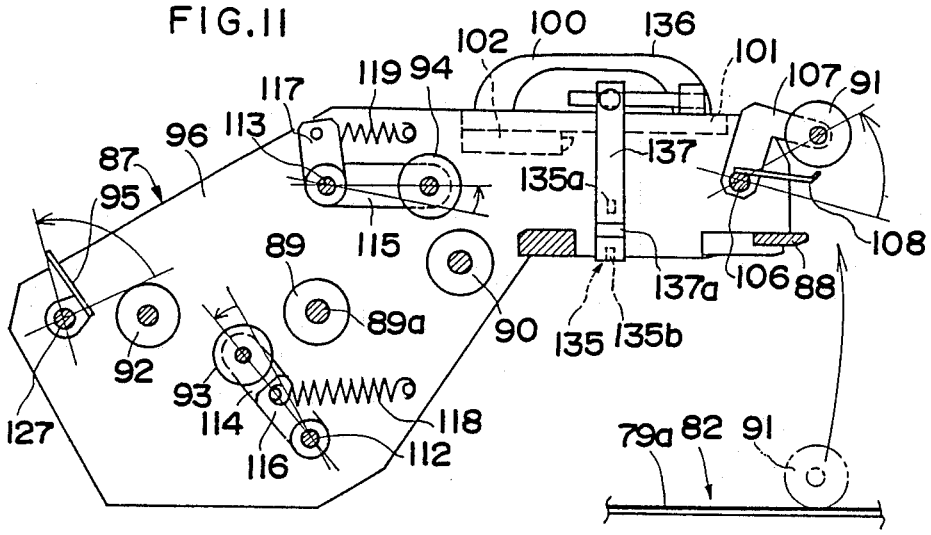
FIG. 11 is a longitudinal sectional view of the labelling unit in the state opened upward.

When the plate 96 is lifted the operating lever 109 of the rotary shaft 106 is separated upward from the bracket 103 on the base. Therefore, the rotary 106 rotates under the influence of the spring 110 until the operating lever 109 touches the stopper pin 111. Following this movement, the label presser roller 91 and the presser plate 108 pivot upward as shown in FIG. 1, providing an opening between the knife member 88 and the presser plate 108. Moreover, since the cam follower rollers 122, 123 are pushed out from the indentations 125, 126 of the fixed disk-shaped cam 124, the presser rollers 93, 94 swing in the direction to go away from the cylindrical faces of the driving rollers 89, 90, against the force of the springs 118, 119, through the arms 120, 121, the rotary shafts 112, 113 and the bearing arms 114, 115. An opening is thus provided between the presser rollers 93, 94 and the driving rollers 89, 90 as shown in FIG. 11. In addition the rotary shaft 127 supporting the elastic braking board 95 moves in a direction to cause the operating lever 128 to rotate upward under the force of the spring 129 to touch the stopper pin 130. This rotation is transmitted to the elastic braking board 95 through the rotary shaft 127, and the said elastic braking board 95 moves away from the guide roller 92 as indicated in FIG. 11. An opening is thus provided between the elastic braking board 95 and the guide roller 92.

The threading of the label carrier 83A can be performed easily, because each part through which the label carrier 83A passes can be opened automatically by raising the bearing plate 96. When the movable bearing plate 96 is raised in this manner, the plate 101 on the side of the bearing plate 96 is spaced upward from the proximity switch 105 and therefore this proximity switch is turned off, making it impossible to operate the labelling system.

Figure 9:
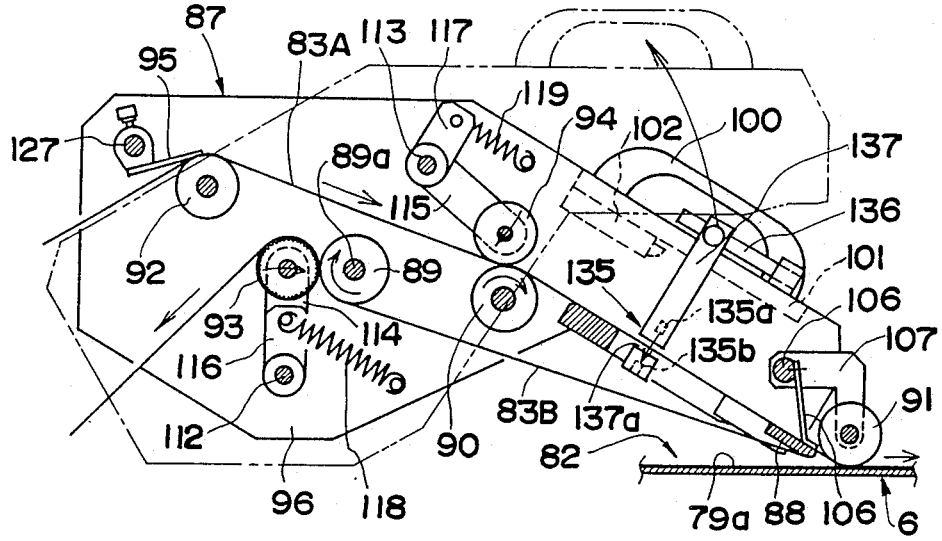
FIG. 9 and FIG. 10 are longitudinal sectional views illustrating the labelling unit which is the means of label pasting.
Figure 10:
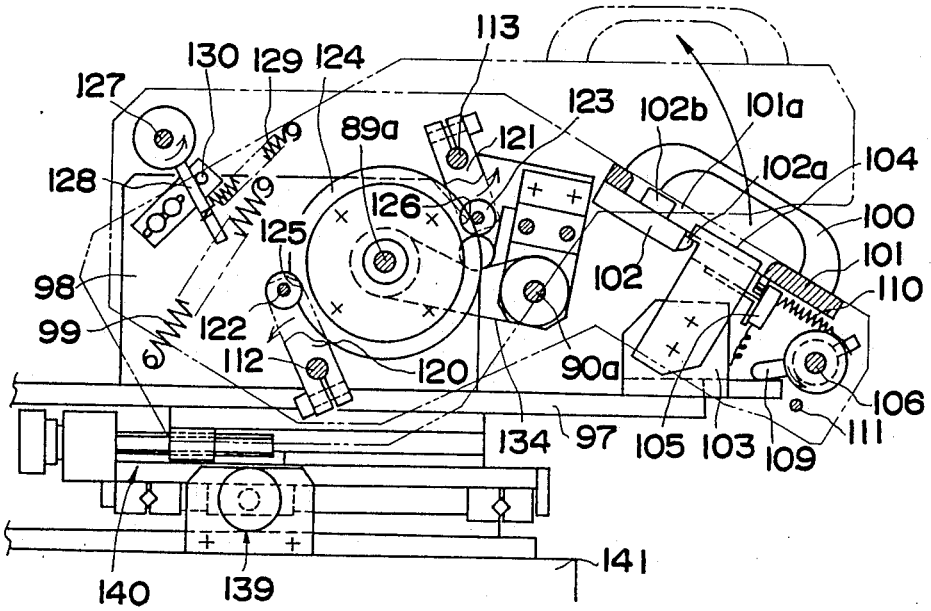

After threading the label carrier 83A as indicated in FIG. 9, bearing board 96 is pushed down with the handle 100, against the force of the spring 99, to make the latch claw **102*a* engage with the moored member 104 to lock the bearing plate 96 in the position indicated by solid lines in FIG. 9. As a result, the operating lever 109 of the rotary shaft 106 contacts the bracket 104 on the base, as shown in FIG. 10. The rotary shaft 106 thus turns against the face of the spring 110, the label presser roller 91 and the presser plate 108 go down in their specified positions, and the presser plate 108 presses the label carrier 83A against the knife edge member 88. Moreover, since the cam follower rollers 122, 123, linked with the presser rollers 93, 94, are now received in the indentations 125, 126 of the fixed disk-shaped cam 124, the presser rollers 93, 94 swing with the pushing force of the springs 118, 119 to pinch the label carrier 83A with the corresponding driving rollers 89, 90 respectively as shown in FIG. 9. Moreover, the rotary shaft 127, supporting the elastic braking board 95, is moved upward above the stopper pin 130 and, as a result, the operating lever 128 is relatively pushed down by the stopper pin against the pushing force of the spring 129. This rotation is transmitted through the rotary shaft 127 to the elastic braking board 95 to press the label carrier 83A against the guide roller 92 as shown in FIG. 9. At the same time, the proximity switch 105 is turned on by detecting the plate 101 as shown in FIG. 10 when the plate 96** is locked in its operating position enabling operation of the system.

When the label carrier 83A is threaded in the labelling unit as explained above, the labels 84 are peeled off from the carrier web 83 as the latter is folded back at the edge of the knife member 88. Therefore, the carrier web 83B without labels passes under the knife member 88. After passing through between the driving roller 89 and the presser roller 93 the label-free carrier 83B is rolled around a winding shaft 133 after passing over a guide roller 131 and tension roller 132.

The driving shafts **89*a*, 90*a* of the respective driving rollers 89, 90 are interlocked with each other in the transmission ratio of 1:1 by a transmission belt 134 (FIG. 12) and one of the driving shafts 89*a* is driven by a motor (not indicated in the drawing) so that both driving rollers 89, 90 turn at the same rotational speed in the specified direction. However, the exit driving roller 89 is designed a little larger in diameter than the infeed driving roller 90 so that the peripheral velocity of the exit driving roller 89 may be somewhat greater than that of the driving roller paper 90. Those two driving rollers 89, 90 are constituted by an elastic material such as silicon rubber, etc., at least in their peripheral faces, and both presser rollers 93, 94 are formed from a metal such as aluminum, etc. The peripheral face of the presser roller 93, which is pressed against the exit driving roller 89, is made rough by knurling, etc., while the presser roller 94, pressed against the infeed driving roller 90 is finished smooth in the peripheral face. Moreover, the strengths of the power springs 118, 119 which push the both presser rollers 93, 94 toward the respective driving rollers 89, 90 are differentiated from each other so that the pressing force of the presser roller 93 may be several to 10 times stronger, approximately, than that of the presser roller 94**.

Consequently, while the stripped carrier web 83B cannot slip on the driving roller 89, the label carrier 83A slips easily on the driving roller 90. Furthermore, since the pulling speed of the exit, driving roller 89 is slightly faster than the surface speed of the infeed driving roller 90, the label carrier 83A is forcibly pulled by the exit driving roller 89 and passes through between the guide roller 92 and the elastic braking board 95, between the infeed driving roller 90 and the presser roller 94, and between the knife member 88 and the presser plate 108 respectively, and then turns back at the tip of the knife member 88 to be drawn between the exit driving roller 89 and the presser roller 93. However, since the label carrier is subject, even when it passes by slipping between the infeed driving roller 90 and the presser roller 94, to the feed action of the driving roller 90, the tension exerted on the label carrier at the time of turning back at the tip of the knife member 88 is reduced as compared with the case of absence of the infeed driving roller 90.

Figure 12:
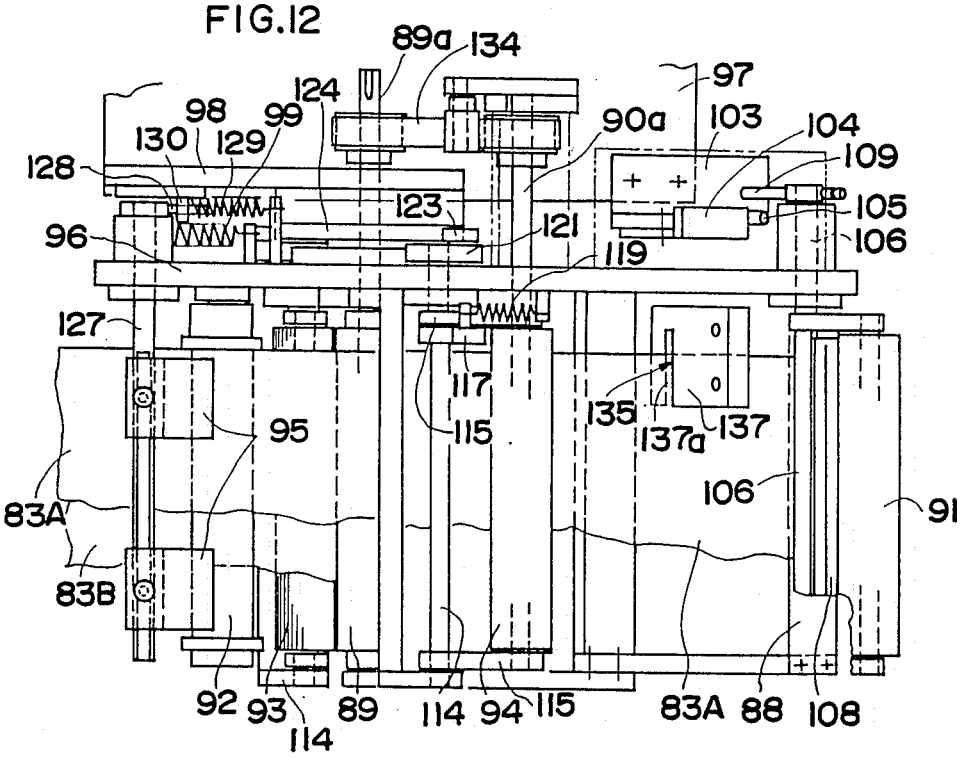
FIG. 12 is a top plan view of the labelling unit.
Figure 14:
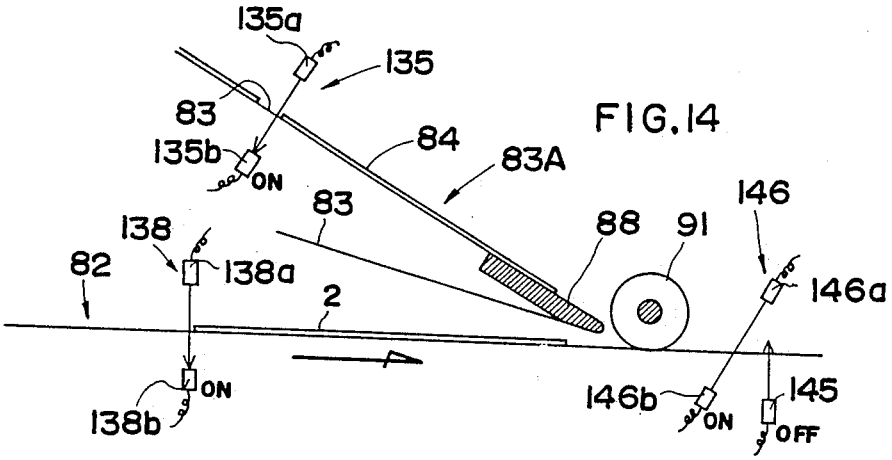
FIG. 14 and FIG. 15 are longitudinal sectional views illustrating the detecting mechanism of the labelling part.
Figure 15:
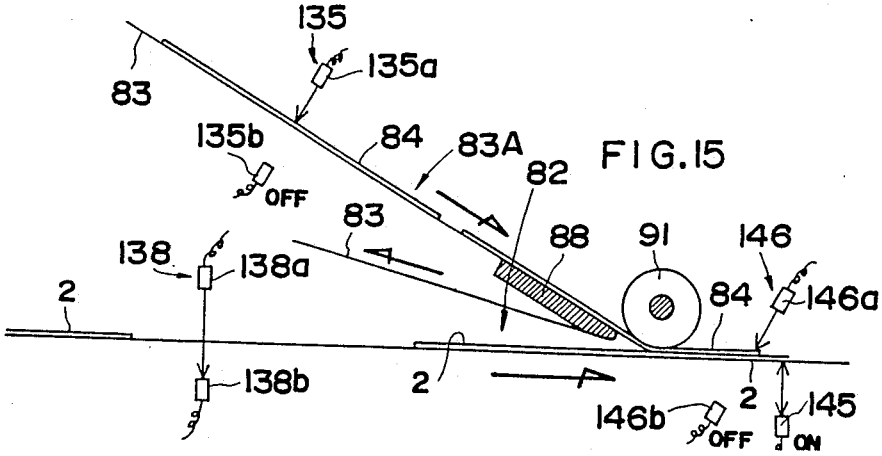

By folding back the label carrier 83A at the edge of the knife member 88 as described above, the labels 84, detachably adhered to the carrier 83, are peeled spontaneously from the carrier 83 and sent out in the direction of extension of the knife member 88 when the carrier 83 turns back at the tip of the knife member 88 as shown in FIG. 13. This happens because the rigidity of the labels 84 is greater than that of the carrier web 83. To adhere the labels 84 thus peeled off to the post cards 2, which are conveyed below at proper intervals, on the horizontal conveying route 82, by means of the said label presser roller 91, the following control is performed:

On the labelling unit 87, a photoelectric switch 135 is provided as indicated in FIG. 9 and FIG. 12, for detecting the passage of a label 84 on the carrier 83A upstream of the knife member 88. The photoelectric switch 135 consists of a projector **135*a* and a receiver 135*b* mounted face to face with each other on opposite sides of a slit 137*a* in a bracket 137 supported by a rod 136 in a way to be positionally adjustable in the direction of movement of the label carrier 83A. The bracket 137 is adjusted in such a way as to cause the switch 135 to be turned on when the beam from the projector 135*a* passes through the carrier web between adjacent labels 84 which are opaque to the light. In addition, the photoelectric switch 135 is positioned in such a way that the detecting position is located at the rear edge of a label 84 when the front edge thereof is located on the knife member 88 as shown in FIG. 14. When it has detected the passage of the rear edge of the label 84 the switch functions to stop the drive of the both driving rollers 89, 90 in the labelling unit 87 and makes the label 84 at the head of the line stop and wait immediately before the edge of the knife member 88 as indicated in FIG. 14**.

The horizontal card conveying route 82 is provided with a photoelectric switch 138 which detects the passage of cards 2, at a position upstream of the edge of the knife member 88 by a distance approximately equal to the length, in direction of conveyance of the post cards 2. The photoelectric switch 138 consists of a projector **138*a* and a receiver 138*b*, and starts the drive of the both driving rollers 89, 90 in the labelling unit 87, when it has detected the passage of the rear edge of a card 2 carried on the conveying route 82**.

Thus, the label carrier 83A is conveyed by the driving rollers 89, 90 which turn in linkage with the detecting action of the said photoelectric switches 135 and 138. As a result, the label 84 in the foremost position, at a stop and waiting immediately before the tip of the knife member 88 as shown in FIG. 14, is peeled off from the ground paper and sent out from the tip of the knife edge member 88 as explained earlier. The position, etc. of the said photoelectric switches 135, 138 is adjusted in such a way that the label 84 may just overlap the specified position on the surface of a card carried on the said conveying route 82.

As described above, the labels 84 sent out from the tip of the knife member 88 are pressure adhered at the specified position on the surface of the post cards carried on the conveying route 82 by the label presser roller 91, and are finally detached completely from the ground paper 83. Of course, the feed velocity of the label carrier 83A and the transfer speed of the labels 84 on the conveying route 82 are the same. However, since the interval of conveyance of post cards 2 on the conveying route 82 is set sufficiently large compared with the interval of labels 84 on the carrier web 83A, the transfer of the label carrier 83A is performed intermittently with the functioning of the label-detecting photoelectric switch 135 and the card detecting photoelectric switch 138, and the labels 84 are sent out intermittently from the knife member 88, subject to the arrival at the labelling position of the post cards 2.

The base plate 97, supporting the above-mentioned labelling unit 87 through the driving shaft **89*a*, is supported on a fixed frame 141 (FIG. 10) by a transverse position adjusting device 139 and a longitudinal position adjusting 140. Therefore, the position of the labels 84 sent out from the tip of the knife edge member 88 can be freely adjusted forward and backward and to left and right by adjusting the position of the labelling unit 87 by means of those positions adjusting devices 139, 140**.

In the manner explained above, the cards 2 carried at proper intervals on the conveying route 82 are furnished with labels 84 automatically. Whether or not the label 84 is pasted at the prescribed position is detected in the following way:

As shown in FIG. 14 to FIG. 17, the conveying route 82 under the label presser roller 91 of the labelling unit 87 is provided with a reflection photoelectric switch 145 which detects from underneath the front edge of a card on the conveyor belt 142 through opening 144 provided in a plate 143 supporting the conveyor belt. A second photoelectric switch 146, which detects the front edge of the label 84 adhered at the specified position on the card 2, also projects through the opening 144. The photoelectric switch 146 consists of a projector **146*a* provided over the opening 144 and a receiver 146*b* provided under the opening, and is adjusted in such a way that the beam from the projector 146*a* may pass through the post card 2 but not through both the label 84 and the post card 2**.

Therefore, if the label 84 is pasted at the specified position on the post card 2 and the distance between the front edge of the post card 2 and the front edge of the label 84 is normal, the label detecting photoelectric switch 146 detects the front edge of the label 84 at the same time as the photoelectric switch 145 has detected the front edge of the post card 2. If the distance between the front edge of the post card 2 and the front edge of the label 84 is too large, the label detecting photoelectric switch 146 does not detect the front edge of the label 84 even if the photoelectric switch 145 has detected the front edge of the post card 2. On the contrary, in a case where the distance between the front edge of the post card 2 and the front edge of the label 84 is too small, the label detecting photoelectric switch 146 detects the front edge of the label 84 before the photoelectric switch 145 detects the front edge of the post card 2.

Figure 16:
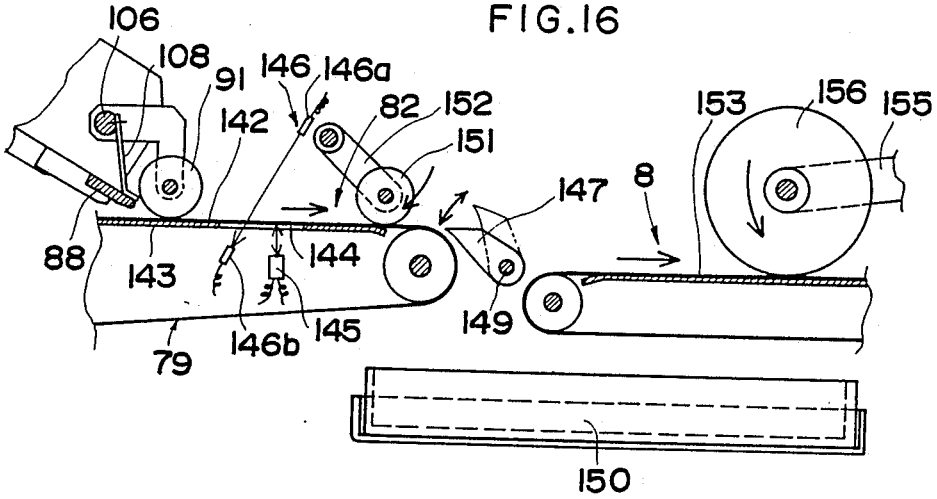
FIG. 16 is a fragmentary longitudinal sectional view illustrating the part of separation and collection of defective products.
Figure 17:
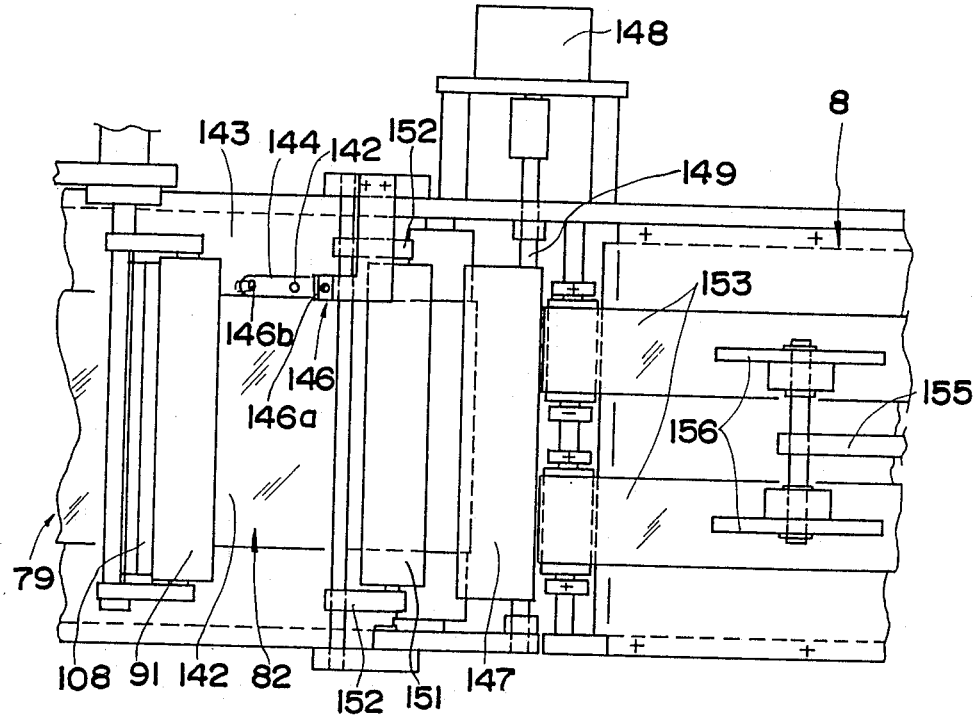
FIG. 17 is a top plan view of the mechanism of FIG. 16.

As indicated in FIG. 16 and FIG. 17, an opening-closing gate 147, for separation and recovery of defective cards, is provided between the conveying route 82 and a collecting device 8 for cards furnished with proper labels. The gate 147 is mounted on a rotary shaft 149, which is driven by a rotary solenoid 148 and is usually maintained in the "closed" position, as indicated by solid lines in FIG. 16, with the force of a spring. If anything unusual is detected by the photoelectric switches 145, 146 about the position of the labels 84 on the post cards 2 passing though the detecting position, the rotary solenoid 148 is actuated and the gate 147 opens upward, as shown by broken lines in FIG. 16, to divert the defective cards into a collecting tray 150 below.

The reference numeral 151 designates a presser roller provided immediately before the gate 147 and is pushed downward between a pair of bearing arms 152 which are swingable in upward and downward directions.

The collecting device 8 is a known device consisting, as shown in FIG. 1, of a pair of belt conveyors (left and right) 153 much slower than the feed velocity of post cards 2 from the conveying route 82. A slant plate 154 is installed obliquely at the terminal position of the belt conveyor 153 for arresting the cards. A pair of presser wheels (left and right) 156 are supported and pushed downward by a bearing arm 155 swingable in upward and downward directions. The collecting device 8 is designed to collect the cards that pass over the said gate 147, in a posture standing obliquely along the slant plate.

As shown in FIG. 1, the carrier web 83B, deprived of labels, passing over the driving roller 89, is rolled on the driving shaft 133. As detailed in FIG. 18 and FIG. 19, the driving shaft 133 is continuously driven in the winding direction by a motor 157 and the web 83B is continuously rolled. However, since the web 83B is, as explained earlier, advanced intermittently by the driving roller 89, which is driven intermittently but at a higher speed than the winding shaft 133, the web 83B droops when it is advanced at high speed. Such drooping of the web 83B is absorbed by the tension roller 132.

The tension roller 132 is supported in cantilever fashion at the free end of a bearing arm 161 which is supported to swing in upward and downward directions by a supporting shaft 160 on the bracket 159 which supports the winding shaft 133. A power spring 162 is provided between the bearing arm 161 and the bracket 159. The spring is arranged to contract to the minimum when it is about at the central position of the range of swinging of the arm 161 in upward and downward directions. Of course, the power spring 162 does not have such a tension as to forcibly pull the tension roller 132 to the central position but is intended to help upward movements of the roller 132 from a lower limit position and ensure correct downward movements of the roller 132 from an upper limit position.

Figure 18:
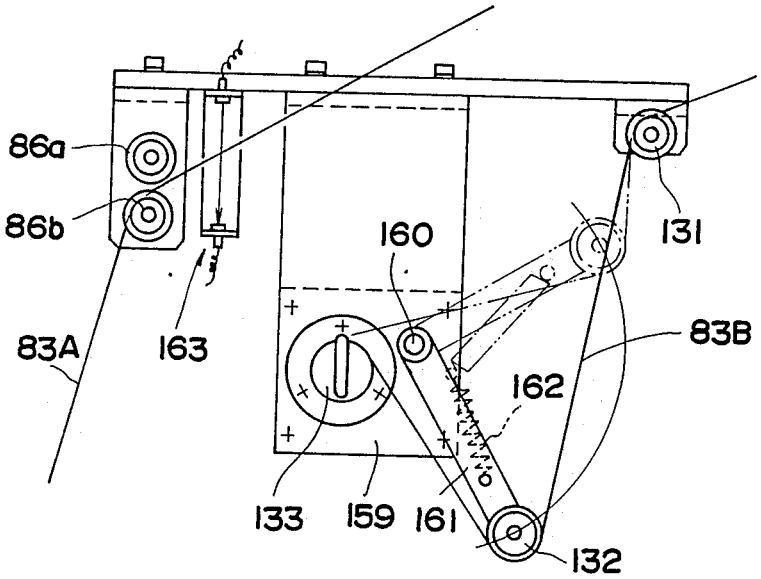
FIG. 18 is a side elevational view illustrating the means of carrier paper collection by winding.
Figure 19:
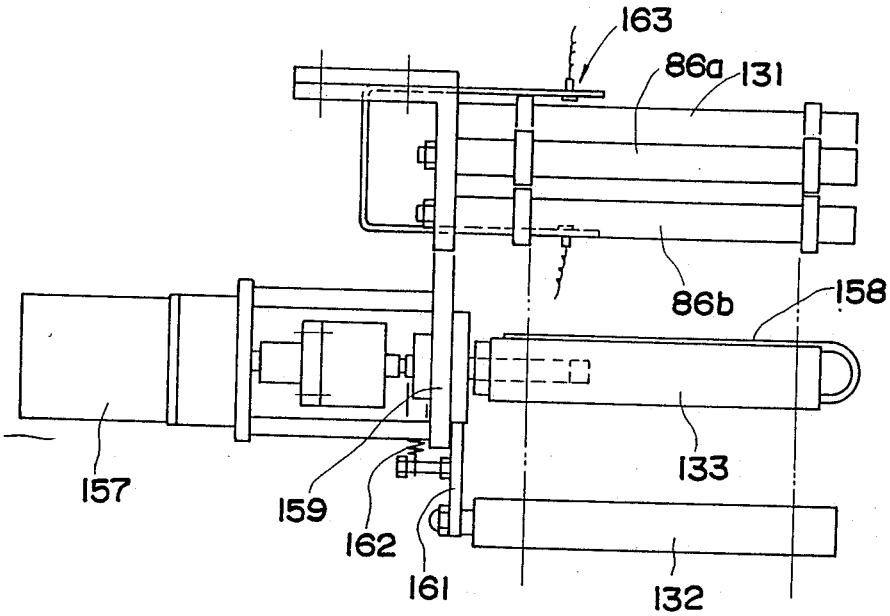
FIG. 19 is a rear elevation of the above.

A photoelectric switch 163, for detecting the presence of carrier web 83, is provided beside guide rollers (upper and lower) **86*a*, 86*b* installed in the route which feeds the label carrier 83A to the labelling unit 87 as shown in FIG. 18 and FIG. 19. The switch 163 is used to detect the end of passage of the label carrier 83A** and, in such case, make an automatic stop of operation of the labelling system.

The apparatus of the present invention has the following features and advantages:

(1) For the purpose of loosening and separating cards a lower separating device is provided near the end of the horizontal conveyor. The apparatus of the present invention can reliably convey the cards one by one in the upward direction by means of a vertical conveying device associated with the said horizontal conveying device.

(2) By providing first and second separating devices at the upper end of the vertical conveying device, it can reliably send the cards one by one in a row to the labelling position, even if by chance a number of cards are about to be conveyed.

(3) By moving the labelling unit upward, away from the conveying route of the cards, a wide opening is formed between a knife member for peeling labels and the said conveying route. Also, the pressure rollers 93, 94 are moved away from their respective driving rollers 89, 90, and the braking board 95 is retracted from the roller 92. Therefore, the apparatus of the invention enables the carrier web to be threaded easily through the apparatus without fear of braking the web unexpectedly during threading, even if the ground paper with labels is an easily breakable one having perforation. Moreover, the maintenance, inspection and repair can be made quite easily not only to different parts of the labelling unit but also to the conveying route.

(4) Since the invention is constructed in such a way that the label carrier is made to pass between an infeed driving roller, the surface velocity of which is slower than that of the exit driving roller for pulling the web which has turned back at the knife edge, and slipping is easier between the infeed driving roller and the carrier web than between the exit driving roller and the web, it is possible always to maintain the label carrier in a strained condition even on the upstream side of the knife member. By so doing, it is possible to assure a correct adhering of labels on cards by making the label carrier synchronized with the cards advancing on the conveying route. Yet the present invention can largely avoid excessive tension being exerted on the web. Therefore, the present invention can avoid inconvenience resulting from web breakage when the web turns back at the edge of the knife member, even if zigzag folding web, having perforations at the folding points as shown in the example, is used. Moreover, although the label carrier web is fed intermittently, the tension exerted on the web at the starting time of intermittent feed is reduced by the feeding action of the infeed driving roller, and there is no risk of unexpected breaking of the web even if the feed velocity of the web is increased to raise the label pasting capacity (5) When a post card, etc., furnished with a label and carried out from the labelling system has reached a specified position, the present invention can detect automatically and reliably, by means of photocell detecting devices, whether the position, in the longitudinal direction, of the pasted label is normal or not. And if both detecting devices do not detect simultaneously the front edge of the post card and the front edge of the label, the defective post card can be diverted automatically by opening upward the gate 147. Thus, the present invention can completely eliminate the necessity of any artificial checking of the position of pasted labels and any separation and collection of defective products by manual work.

What is claimed is:

1. A labelling system for applying adhesive labels to a series of post cards or the like including conveyor means for conveying cards or the like to be labelled one at a time along a labelling path, and a labelling mechanism positioned alongside said labelling path for successively applying labels to cards being advanced along said path, said labelling mechanism comprising (a) web guide means for guiding a label carrier web toward a labelling position along said path, (b) said web guide means including a guide roller and cooperating pressure member for retaining the passage of said carrier web, (c) a knife member for sharply reversing the direction of travel of said carrier web at the labelling position, (d) an exit drive roller and cooperating pressure member for pulling said carrier web on the exit side of said knife member, (e) means mounting said labelling mechanism for swinging movement toward and away from said conveyor means about an axis remote from said knife member to allow said knife member to be retracted from said conveyor means for threading of a carrier web, and (f) cam-like means co-acting with each of said pressure members and operative upon swinging of said labelling mechanism for retraction of said knife member to effect separation of said cooperating pressure members in order to free said carrier web for unimpeded movement through the mechanism for web threading operations.

2. Apparatus according to claim 1, further characterized by (a) a further pressure member cooperating with said knife member and operative normally to press said carrier web against the surface of said knife member, and (b) cam-like means co-acting with said further pressure member for retracting said further pressure member automatically upon retraction of said knife member from said path.

3. Apparatus according to claim 2, further characterized by (a) said labelling mechanism including a frame (b) said cam like means including a cam member, fixed to said frame and rotatably therewith about said axis, (c) at least certain of said cooperating pressure members being mounted on said frame for swinging movement about axes remote from said first mentioned axis, and (d) cam follower elements associated with said certain cooperating pressure members and cooperating with said cam member, (e) said cam follower elements being displaced movement thereof about said cam member resulting from swinging of said frame about said first mentioned axis.

4. Apparatus according to claim 1, further characterized by (a) the conveyor means including a first horizontal conveyor, a vertical conveyor and a second horizontal conveyor, (b) said first horizontal conveyor advancing cards or the like in upright position, supported on their bottom edges, toward said vertical conveyor, (c) said vertical conveyor including a suction belt for suction engagement with the front-most card, (d) separator means adjacent the upper end of said suction belt comprising a pair of opposed rollers spaced apart a distance sufficient to permit the passage of a single card, (e) the direction of rotation of said rollers being such that the roller engaging a card on the same side as the suction belt tends to advance the card in the same direction as the belt and the roller engaging a card on the opposite side tends to direct the card in the opposite direction.

5. Apparatus according to claim 1, further characterized by (a) an infeed driving roller engaging said carrier web in advance of said knife member and driving said web toward said member, (b) said exit drive roller being driven at a speed slightly greater than said infeed driving roller and having a superior frictional grip on the carrier web than said infeed driving roller, whereby said carrier web is maintained under tension around said knife member at all times.

6. Apparatus according to claim 5, further characterized by (a) said infeed roller is formed with a relatively smooth surface, whereby said carrier web may slip easily on said surface.

7. Apparatus according to claim 1, further characterized by (a) first and second photocell sensors positioned adjacent said labelling position, immediately downstream thereof, (b) one of said sensors being responsive to the presence of the leading edge of a card and the other of said sensors being responsive to the leading edge of a label, (c) means defining a gap in said conveyor system, (d) a diverter gate in said gap responsive to said photo-cell sensors and operative to divert any labelled card on which the leading edge of the label is not properly aligned with the leading edge of the card.

8. Apparatus according to claim 1, further characterized by (a) a windup for said carrier web positioned downstream of said exit drive roller and arranged to receive carrier web stripped of labels, (b) photocell sensor means for stopping and starting the driving rollers for said carrier web, in response to the presence or absence of a card adjacent said labelling position.

(c) means for continuously driving said windup, and (d) a movable tension roller engaging said web between the intermittently driven exit drive roller and said windup to accommodate momentary variations between the rate of carrier windup and the rate of carrier advance.

* * * * *